United States Patent [19]

Lehman

[11] Patent Number: 4,466,212

[45] Date of Patent: Aug. 21, 1984

[54] INFLATABLE SAUCER TOY WITH SHAPE HOLDERS AND WEIGHTS

[76] Inventor: James A. Lehman, 362 N. Seymour St. (Apt. 218), Fond du Lac, Wis. 54935

[21] Appl. No.: 404,214

[22] Filed: Aug. 2, 1982

[51] Int. Cl.[3] ..... A63H 27/00

[52] U.S. Cl. ..... 446/46

[58] Field of Search ..... 46/74 D, 87, 89; 273/424, 425, 428; 9/11 A

[56] References Cited

U.S. PATENT DOCUMENTS 2,170,539 8/1939 Schoberg ..... 46/87
2,864,201 12/1958 Leise ..... 273/424 X
4,135,325 1/1979 Lehman ..... 46/74 D
4,254,575 3/1981 Gould ..... 46/74 D

*Primary Examiner*—Mickey Yu

[57] ABSTRACT

The invention pertains to an improved inflatable flying saucer toy which is comprised of two pieces capable of being joined by male and female construction. The saucer is made up of an upper dome section, an upper lip section, a lower lip section, an inside lip section, and a lower dome section all of which may individually be thicker than the remaining sections or which may have reinforcement rings molded into them to hold the saucer in an ideal aerodynamic shape. The shape holding features of the saucer can also provide additional weight to the saucer.

8 Claims, 6 Drawing Figures

FIG. 1
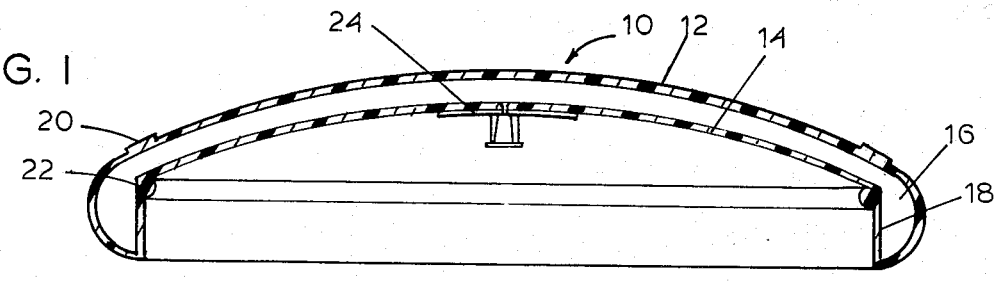
FIG. 2
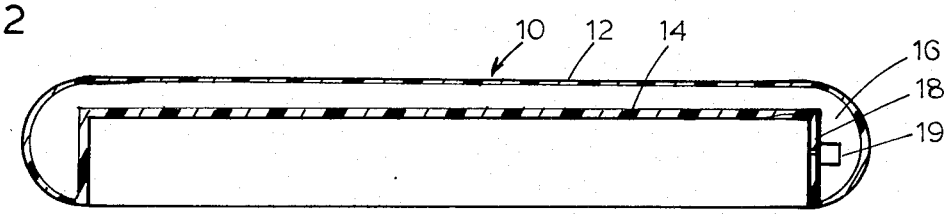
FIG. 3
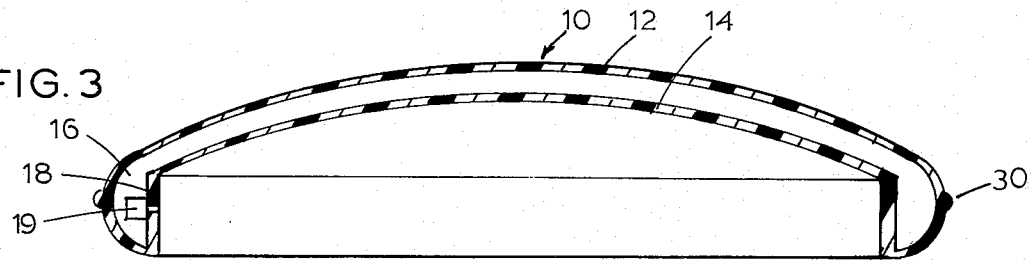
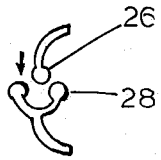
FIG. 4
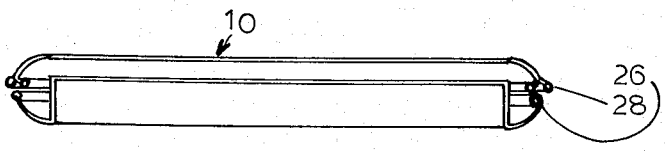
FIG. 5
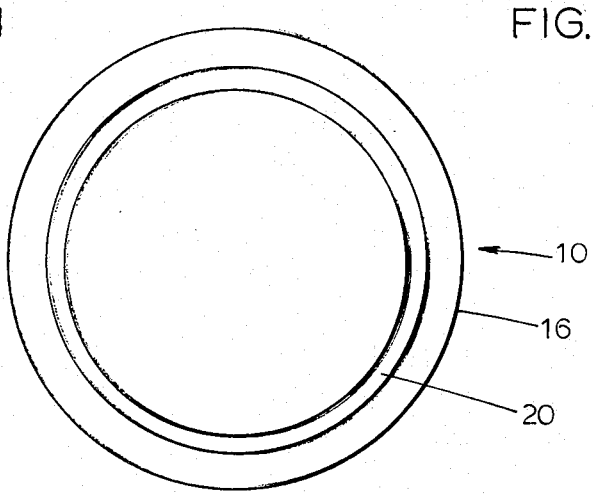
FIG. 6

INFLATABLE SAUCER TOY WITH SHAPE HOLDERS AND WEIGHTS

BACKGROUND OF THE DISCLOSURE

This invention is a flying saucer which is a modification and improvement upon an Inflatable Saucer developed by the inventor for which a patent has been granted having U.S. Pat. No. 4,135,325. A patent is also pending by the inventor for an Inflatable Saucer With Connector Columns filed June 3, 1982. The connector columns of that invention also holds the shape of the saucer, and adds weight, but they are located in the dome area only. The present invention overcomes the problems that can arise with having shape holders located only in the lip by locating shape holders in the upper dome section, the upper lip section, the lower lip section, the inside lip section, and the lower dome section.

SUMMARY OF THE INVENTION

The saucer of the instant invention is adapted from the original Inflatable Saucer and utilizes novel shape holding features which serve to maintain an ideal aerodynamic profile when the saucer is inflated or even overinflated to some extent.

The shape holders may be intregral with the saucer or may be bonded to the saucer and they may be made of rubber, plastic, leather, or metal or any material that would lend itself to such an application. The weight of the shape holders can be made to vary significantly by changing their thickness and composition.

The foregoing and various other features and objects of the invention will appear in the course of the description which is rendered below with reference to the accompanying drawings wherein the same reference numerals depict the identical element or part.

BRIEF DESCRIPTION OF THE DRAWINGS

FIG. 1 depicts a cross section view of the device showing a mouth valve located in the central underside, and a shape holding ring in the upper dome in the vicinity of the upper lip along with a shape holding ring located on the lower dome in the vicinty of the inside lip section.

FIG. 2 depicts a device with a needle valve located in the lip, and a lower dome and inside lip section which is approximately twice the thickness of the remaining wall sections.

FIG. 3 depicts a cross section view of a saucer with an entire lip which has thicker wall sections than the remainder of the saucer and with a shape holding ring located on the exterior of the lip connecting the upper lip section with the lower lip section.

FIG. 4 depicts a cross sectional enlargement viewing a male and female connecting mechanism which join the top and bottom halfs of the saucer, and which when joined constitute a shape holding ring.

FIG. 5 shows the female and male connectors as they are incorporated into the saucer.

FIG. 6 is a top view of the saucer shown in FIG. 1.

DETAILED DESCRIPTION OF THE EMBODIMENTS

A saucer toy 10, is shown in FIGS. 1, 2, and 3 which is typical of existing flying saucer toys which have a depending lip 16, and dome—which in the case of an inflatable saucer is made up of an upper dome section 12, and a lower dome section 14.

In FIG. 1 the inside lip section 18, is shown as flat and parallel to the axis of the saucer and typically about as thick as the remaining saucer sections. At the juncture of the inside lip section and the lower dome section is a shape holding ring 22, which is integral with the saucer. This ring tends to hold the saucer in an ideal aerodynamic shape, and especially helps to keep the saucer from being pulled apart, and also helps to eliminate the effects of over-inflation. This saucer also has an additional shape holding ring 20 molded into the upper dome section and which acts much the same as shape holding ring 22. This device has a mouth patch valve 24 bonded to the lower dome.

In FIG. 2 the saucer shown has a shape holding means made up of an inside lip section 18, and lower dome section 14, which are at least fifty percent thicker than the remaining wall sections. This device has as its air filling means a needle valve 19 positioned in its lip.

The saucer of FIG. 3 has a shape holding ring 18, which serves as the inside lip section, and opposite this feature is a shape holding ring 30, integral with the center of the lip exterior and extending into the upper lip section, and the lower lip section. This saucer also has a needle valve 19, located in its lip.

FIGS. 4 and 5 highlight a way of connecting a saucer which has been molded in two parts which later are joined by spreading a bonding agent into the female cavity 28, and inserting the male feature 26, into the female feature and letting the bonding agent dry—sonic welding may also be used in this application. Joining the two pieces of the saucer with a male and female entity helps in the manufacturing of the saucer in that it speeds up locating one piece to the other, and results in a stronger bond than would be found otherwise.

A top view of the Inflatable Saucer 10, is shown in FIG. 6, to illustrate that the shape holding ring 20, located in the vicinity of the lip 16 is of a full circumference as are all shape holding means regardless of their configuration and location.

Though rather simple in concept the shape holders serve a distinct and very useful purpose in that they make the saucer more efficient in use, and they help to keep the saucer from being damaged. Additionally, they can even help to improve the appearance of the device.

Many changes may be made in details of the instant invention, in the methodand material of fabrication, in the configuration and assemblage of the constituent elements, without departing from the spirit and scope of the appended claims, which changes are intended to be embraced therewithin.

Having thus described the invention, which is claimed as new and useful and desired to be secured by U.S. Letters Patent is:

1. An improved inflatable flying saucer toy comprising: two sections joined at their peripheries by a male and female joining means; one of said two sections having a central dome portion and a first peripheral depending lip forming a generally concave and convex structure, said first peripheral depending lip having one of said male and female joining means formed thereon; the other of said two sections having a central dome portion and a second peripheral depending lip forming a generally concave and convex structure, said second peripheral depending lip including a reversed portion and having the other of said male and female joining means formed thereon, whereby when said two sections are joined by said joining means an unitary saucer toy is formed having an inflatable gas tight chamber between said two sections and when said chamber is inflated through an air filling means on said unitary saucer toy and the unitary saucer toy is held relatively rigid by a shape holding means, the unitary saucer toy 6 can be thrown through the air for a substantially long distance.

2. The invention as defined in claim 1, wherein when said first and second peripheral depending lips are joined form a substantially semicircular shape in cross-section.

3. The invention as defined in claim 1, wherein said air filling means in attached to an underside of said saucer toy.

4. The invention as defined in claim 1, wherein said air filling means is a needle valve.

5. The invention defined in claim 1, wherein said shape holding means is a ring shaped reinforcement molded into one of said central dome portions and concentric wing the center of the saucer toy.

6. The invention as defined in claim 1, wherein shape holding means is a ring shaped reinforcement molded into one of said first and second peripheral depending lips and concentric with the center of the saucer toy.

7. The invention as defined in claim 1, wherein said shape holding means is one of said two sections having a thickness at least fifty percent thicker than the other said two sections.

8. The invention as defined in claim 1, wherein said shape holding means is one of said first and second peripheral depending lips having a thickness at least fifty percent thicker than the rest of the saucer toy.

* * * * *